US007232239B2

(12) United States Patent
Zucker

(10) Patent No.: US 7,232,239 B2
(45) Date of Patent: Jun. 19, 2007

(54) ERGONOMIC CEILING MOUNTED LAMP

(75) Inventor: Ulrich Zucker, Ehringshausen (DE)

(73) Assignee: Trilux-Lenze GmbH & Co. KG, Arnsberg (DE)

( * ) Notice: Subject to any disclaimer, the term of this patent is extended or adjusted under 35 U.S.C. 154(b) by 114 days.

(21) Appl. No.: 11/103,369

(22) Filed: Apr. 11, 2005

(65) Prior Publication Data

US 2006/0139925 A1 Jun. 29, 2006

(30) Foreign Application Priority Data

Apr. 10, 2004 (DE) ..... 10 2004 017 686

(51) Int. Cl.
*F21S 4/00* (2006.01)

(52) U.S. Cl. ..... 362/217; 362/147; 362/221; 362/222; 362/225; 362/243; 362/279

(58) Field of Classification Search ..... 362/147, 362/217, 221, 222, 225, 279
See application file for complete search history.

(56) References Cited

U.S. PATENT DOCUMENTS 4,562,517 A 12/1985 Pankin ..... 362/147
6,059,424 A * 5/2000 Kotloff ..... 362/220
6,739,734 B1 * 5/2004 Hulgan ..... 362/243

FOREIGN PATENT DOCUMENTS

| | | | |
|---|---|---|---|
| DE | 3412162 C1 | | 8/1985 |
| DE | 297 12 314 | | 10/1997 |
| DE | 196 47 487 | | 5/1998 |
| DE | 100064101 A1 | | 8/2001 |
| DE | 10112055 A1 | | 10/2002 |
| EP | 574761 | | 12/1993 |
| EP | 1359371 | | 11/2003 |
| GB | 2190735 | | 11/1987 |
| JP | 10-074417 | * | 3/1998 |
| WO | WO9829683 | | 7/1998 |

* cited by examiner

*Primary Examiner*—Renee Luebke
*Assistant Examiner*—Mary Zettl
(74) *Attorney, Agent, or Firm*—Grossman Tucker Perreault & Pfleger, PLLC

(57) ABSTRACT

Described is a lamp which includes two fluorescent tubes arranged in parallel relationship and light distribution chambers which extend laterally therefrom on both sides, and a light-technical louver element arranged beneath the fluorescent tubes, for delimiting the light radiating angle of the fluorescent tubes downwardly, wherein arranged between the fluorescent tubes is an elongate trough which is in the form of a mirror on its outside, for accommodating the electronic operating elements for the fluorescent tubes (FIG. 1).

8 Claims, 2 Drawing Sheets

ERGONOMIC CEILING MOUNTED LAMP

Figure 1:
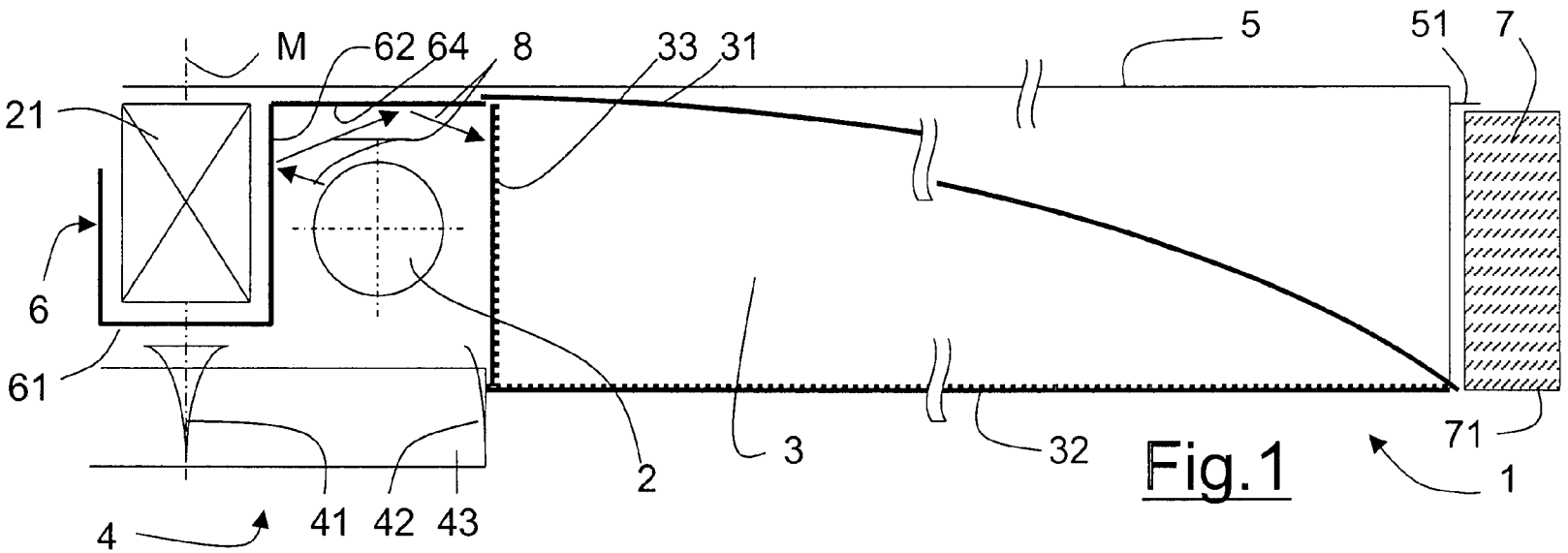

The present invention concerns an ergonomic ceiling mounted lamp which is particularly suitable for lighting offices with VDU work stations.

Lamps of that kind usually have as the lamp means gas discharge lamps or fluorescent tubes, below which are arranged so-called light-technical louver elements, as are known for example from DE 34 12 162 C1, by means of which the light emitted by the fluorescent tube is directed and radiated free from dazzle in a downward direction. Although such lamps provide for excellent work station illumination, the room light conditions are found to be disagreeable as there is no diffuse light which illuminates the ceiling and walls. In the case of ceiling mounted hanging lamps of that kind it is therefore provided that the fluorescent tubes also shine light non-directedly upwardly against the ceiling and light up the room by diffuse light reflected from the ceiling.

In the case of built-in ceiling lamps it is usual to provide laterally of the fluorescent tubes so-called light distribution chambers into which the light radiated laterally from the fluorescent tubes passes and is diffusively radiated by way of substantially horizontally extended, diffusely transparent radiating surfaces which are of comparatively large area, see for example WO 98/29683, DE 279 12 314 U1, DE 100 06 410 A1 and DE 101 12 055 A1. By virtue of the comparatively large vertical extent of such lamps they can be used essentially only in rooms with a suspended ceiling, in which there is still a sufficient airspace available above the visible ceiling. In addition, for adequate light density in respect of the lateral light distribution chambers, it is necessary for additional lamp means to be provided within the light distribution chambers or for the light radiating area thereof to be suitably restricted.

The object of the invention is to provide such a ceiling mounted lamp with fluorescent tubes, louver and lateral light distribution chambers, which is of a small structural height. A further object of the invention is to provide a lamp without additional lamp means in the lateral light distribution chambers for adequate light density of the radiation surfaces of the light distribution chambers. Finally another object of the invention is to provide a lamp with a lamp density, that is as uniform as possible, of the radiation surfaces of the lateral light distribution chambers, in particular also with the avoidance of shadow formation, in particular in the region adjacent to the louver.

The subject-matter of the invention is accordingly a lamp which includes two fluorescent tubes arranged in parallel relationship and light distribution chambers which extend laterally therefrom on both sides, and a light-technical louver element arranged beneath the fluorescent tubes, wherein arranged between the fluorescent tubes is an elongate trough which is in the form of a reflector on its outside, for accommodating the electronic control elements for the fluorescent tubes.

Preferably the trough is of a substantially rectangular section, with an upwardly-directed opening. A respective one of the fluorescent tubes is arranged on both sides of the trough. The louver extends beneath the trough and the fluorescent tubes. Preferably the part of the side walls of the trough, which projects above the upper edge of the fluorescent tubes, is angled inclinedly outwardly and extends further horizontally outwardly above the fluorescent tubes so that a substantial part of the light emitted by the adjacent fluorescent tube in the direction of the central plane of the lamp is deflected by the reflecting side of the trough which is towards the fluorescent tube and its also reflecting horizontal extent, in a direction towards the lateral light distribution chamber. That provides for an enhanced entry of light into the light distribution chambers.

The trough is linked to the further technical advantage that, in the case of flat lamps, it enhances longitudinal stiffness and accordingly the lamp housing can be of a correspondingly filigree nature.

The light distribution chambers comprise a substantially vertical boundary wall of transparent, diffusively light-scattering material, which is adjacent to the respective fluorescent tube and through which light passes into the light distribution chamber, a laterally extending lower boundary wall of also transparent, diffusely light-scattering material, through which light is diffusively emitted from the light distribution chamber, and an upper opaque cover member which is reflective towards the inside of the light distribution chamber and can comprise for example polished aluminum sheet. A structure in the form of white-powdered steel sheet is inexpensive.

Preferably the light radiating surface and the upper opaque cover member converge in the course of their lateral extent so that they meet at a common outer edge which is parallel to the fluorescent tubes, and the light distribution chamber is therefore of a substantially triangular cross-section.

Preferably the ratio of the lateral extent of a light distribution chamber and its vertical extent is at least 3:1, particularly preferably at least 4.5:1.

A suitable transparent light-scattering material is glass or translucent plastic materials with a surface which is roughened for a light-scattering effect, preferably a surface which is roughened on both sides, or plastic materials with light-scattering inclusions. The inner surface of the light radiating surfaces of the light distribution chambers are preferably provided with a step structure which is parallel to the fluorescent tube and which ensures light incidence which is as approximately perpendicular as possible.

Preferably at least one of the upper and lower boundary surfaces of the light distribution chambers, as viewed from the exterior, is of a convex configuration, thus providing good lateral light density distribution in respect of the emission surface. In that way it is possible, with a ratio of the lateral extent of the light distribution chambers to the vertical extent thereof (height of the vertical boundary wall adjacent to the fluorescent tube) of between 4:1 and 7:1, to achieve a light density for the light radiating surface, which is perceived as uniform and even for the eye.

When the lamp is in the form of a surface-mounted lamp, the light radiating surface is preferably of a convex configuration and the reflector is flat and parallel to the ceiling.

When the lamp is in the form of a built-in lamp the radiating surface can be flat and, after the lamp has been installed, can be flush with the underside of the ceiling, and the reflector can be convex. A particularly preferred embodiment of the lamp is such that only a part of the structural height of the lamp is sunk in the ceiling and the lamp extends in other respects from the underside of the ceiling into the room, wherein the light radiating surfaces of the lateral light distribution chambers convexly approach the underside of the ceiling. That affords particularly pleasing aesthetics for the lamp. In addition, that arrangement makes it possible to achieve a required built-in installation depth which does not exceed the thickness of normal ceiling cladding panels.

In accordance with a further preferred embodiment of the invention the louver is integrated into the lamp body so that the underside of the louver is aligned with the underside of the light radiating surfaces of the light distribution chambers. In that case there is the risk that the edge regions, adjacent to the louver, of the light radiating surface of the light distribution chambers are shaded by the outer side bar portions of the louver. In the preferred embodiment therefore the perpendicular light entry wall of the light distribution chamber is such that at its lower edge it has a lateral projection or offset portion and that offset portion is illuminated by light reflected from the mirror above the fluorescent tube.

In accordance with the invention it is possible to produce lamps of the general kind set forth, whose structural height is less than 4 times, preferably less than 3.5 times, the fluorescent tube diameter. It is further possible for more than 60% of the light produced by the fluorescent tubes to be passed into the light distribution chambers so that the average light density of the light radiating surfaces of the light distribution chambers is more than 25% of the average light density of the louver in the case of a light radiating surface ratio of light distribution chambers to the louver of 6:1.

The elements of the invention have been described essentially in the form of elongate profiles extending parallel to the fluorescent tubes. The man skilled in the art is capable of providing closure elements on both sides of the longitudinal extent of the fluorescent tubes in planes transversely with respect to the axis thereof.

Figure 2:
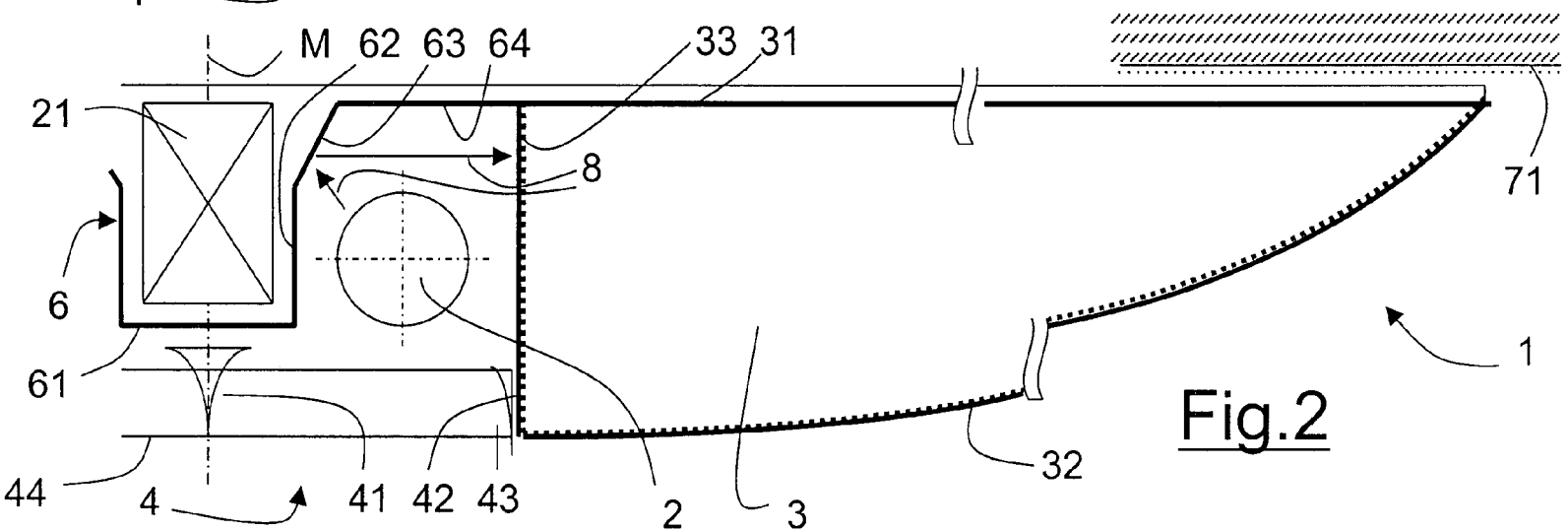
Figure 3:
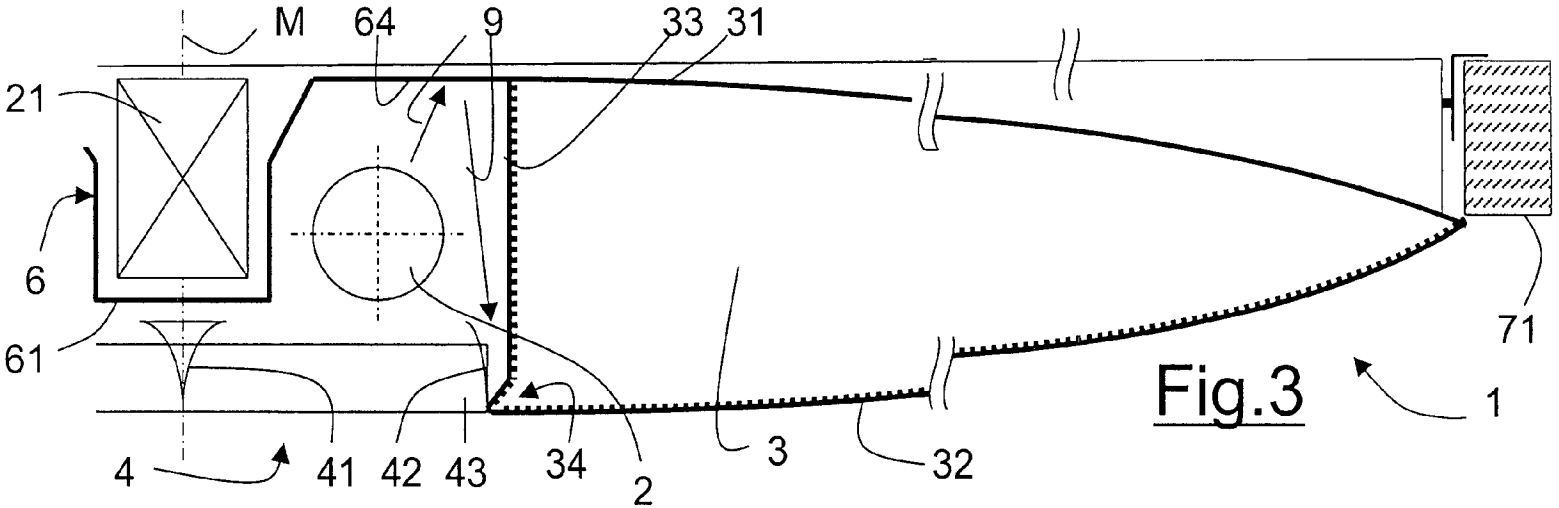
Figure 4:
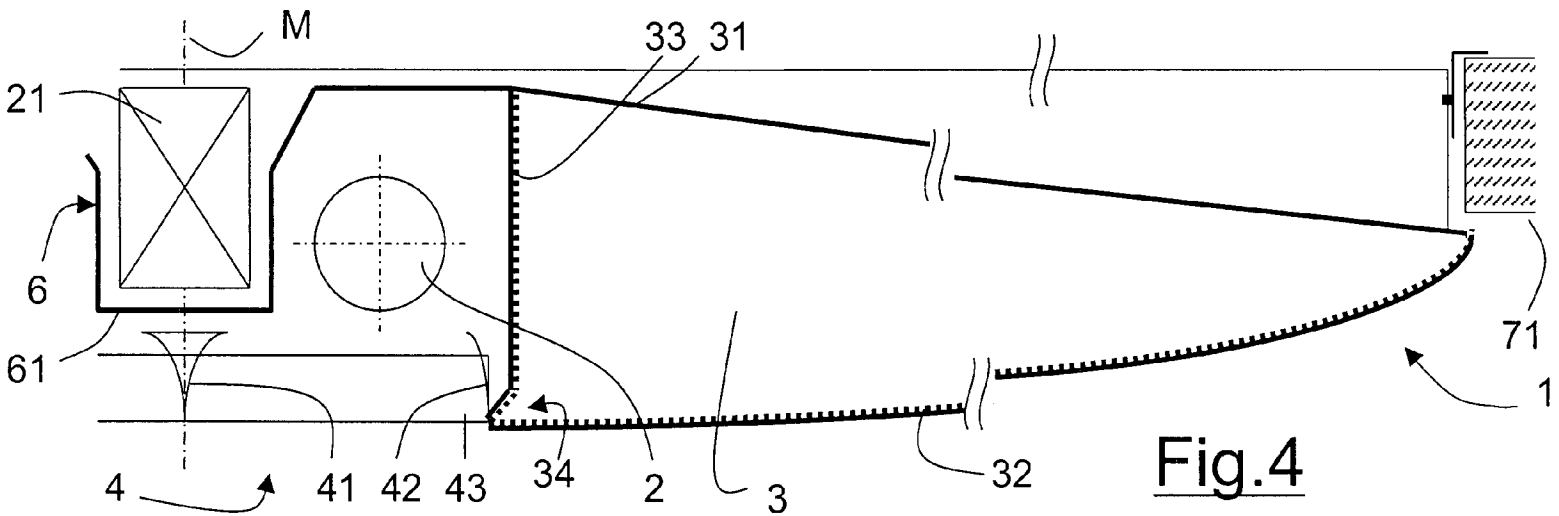

The invention is described in greater detail by way of example hereinafter with reference to diagrammatic cross-sectional drawings, the same elements being identified in the various Figures by the same references. In the drawings:

FIG. 1 is a diagrammatic first embodiment of the invention in the form of a built-in lamp, FIG. 2 is a diagrammatic second embodiment in the form of a surface-mounted lamp, and FIGS. 3 and 4 show two diagrammatic embodiments of built-in lamps in which only a part of the structural height is sunk in the ceiling.

The Figures each show a view in cross-section illustrating one half of the lamp 1 which is symmetrical with respect to the central plane M. The lamp 1 comprises in principle the fluorescent tube 2, the light distribution chamber 3, the louver 4, and optionally the housing 5 with fixing elements 51 which are only partly illustrated for mounting the lamp to the ceiling structure 7. Operation of the fluorescent lamps 2 requires electronic operating elements 21 which in accordance with the invention are arranged within an elongate trough 6 between the fluorescent tubes, the trough being externally in the form of a mirror.

The light distribution chambers 3 in principle comprise an upper boundary wall 31 which inwardly is in the form of a mirror or more diffuse reflector, a vertical boundary wall 33 of transparent, diffusely light-scattering material, which is adjacent to the fluorescent tube 2 and through which light passes from the fluorescent tube into the light distribution chamber, and a lower boundary wall 32 of transparent, diffusively light-scattering material, which serves as a light radiating surface. Alternatively the reflector can be provided at the top side on the housing so that it is not an integral component part of the light distribution chamber 3.

The louver 4 in known manner comprises two side bar portions 42, between which extend a plurality of transverse slats 43; a V-shaped reflector 41 is fitted at the top side on the center of the transverse slats 43.

FIG. 1 shows a built-in lamp 1 with a flat light radiating surface 32 for the light distribution chamber, which is aligned with the lower edge 71 of the ceiling. The reflector 31 is in the form of a convex mirror. The fluorescent tube 2 is disposed in a downwardly open housing which is formed from the perpendicular side wail 62 of the trough 6, an upper mirror 64 and the perpendicular light entry boundary wall 33 of the light distribution chamber 3. The arrows 8 indicate that light emitted from the fluorescent tube towards the trough 6 is deflected into the light distribution chamber 3 by way of the mirror surfaces 62 and 64.

FIG. 2 shows a surface-mounted lamp 1 with a flat reflector 31 and a convexly outwardly curved light radiating surface 32. In the view shown in FIG. 2 the trough 6 is provided with a conical enlargement portion 63 involving a spread angle of between 15 and 40°. Arrows 8 denote deflection of the light from the rear side of the fluorescent tube into the light distribution chamber. In addition in this illustration the louver 4 is incorporated into the lamp body so that the underside 44 of the louver 4 is aligned with the light radiating surface 32.

FIG. 3 shows an embodiment of the invention in which only a part of the structural height of the lamp 1 is sunk in the ceiling 7. The reflector 31 is in the form of a convex mirror. The light radiating surface 32 is also convexly outwardly curved. To avoid shading of the edge of the light radiating surface 32, which is adjacent to the louver 4, by the side longitudinal slat 42, the perpendicular light entry wall 33 of the light distribution chamber has a projection or offset portion 34. The arrows 9 indicate that the projection 34 is illuminated by light which is radiated inclinedly upwardly from the fluorescent tube 2 by reflection at the mirror surface 64, so that shadow formation is avoided.

Finally FIG. 4 shows an embodiment of the invention like FIG. 3, in which the upper boundary wall 31 of the light distribution chamber is in the form of a flat reflector.

A plurality of elements of the invention have been varied in each of the Figures, to simplify the illustrations. That is not intended to denote any limitation of the invention to the combination of given elements. Rather the preferred configuration of the projection 34 shown in FIGS. 3 and 4 can preferably also be used in relation to a surface-mounted lamp as shown in FIG. 2. In addition for aesthetic or light-technical reasons it may be desirable, in the case of a lamp in which the structural height thereof is only partially sunk into the ceiling as shown in FIGS. 3 and 4, for the louver 4 to be only partially or not at all incorporated into the lamp body, as is shown in FIG. 1.

The invention claimed is:

1. A lamp including two fluorescent tubes arranged in parallel relationship and light distribution chambers which extend laterally therefrom on both sides, and a light-technical louver element arranged beneath the fluorescent tubes, for delimiting the light radiating angle of the fluorescent tubes downwardly, and arranged between the fluorescent tubes is an elongate trough which is in the form of a reflector on its outside, for accommodating the electronic operating elements for the fluorescent tubes, wherein the light chambers have substantially perpendicular boundary surfaces of a light-scattering transparent material, which face towards the respective fluorescent tubes and wherein the substantially perpendicular boundary surfaces of the light chambers has an offset portion away from the fluorescent tube at the edge adjacent to the light-technical louver element.

2. A lamp as set forth in claim 1 wherein the ratio of a horizontal extent of the light distribution chambers transverse to the orientation of the fluorescent tubes relative to the vertical extent is at least 3:1.

3. A lamp as set forth in claim 1 wherein top sides of the light chambers are in the form of reflectors and underside comprise a light-scattering transparent material.

4. A lamp as set forth in claim 1 wherein top sides and the undersides of the light chambers converge towards the sides remote from the fluorescent tube.

5. A lamp as set forth in claim 1 wherein undersides of the light chambers are of a convexly outwardly curved configuration.

6. A lamp as set forth in claim 1 wherein an underside of the light-technical louver element is aligned with adjacent lower edges of the light chambers.

7. A lamp as set forth in claim 1 wherein the elongate trough is of a substantially rectangular cross-section with an upwardly disposed opening.

8. A lamp as set forth in claim 1 wherein the elongate trough enlarges upwardly in an upper region.

* * * * *

UNITED STATES PATENT AND TRADEMARK OFFICE

CERTIFICATE OF CORRECTION

PATENT NO. : 7,232,239 B2
APPLICATION NO. : 11/103369
DATED : June 19, 2007
INVENTOR(S) : Zucker It is certified that error appears in the above-identified patent and that said Letters Patent is hereby corrected as shown below:

In column 4, line 65, in Claim 1, delete “has” and insert -- have --, therefor.

In column 4, line 66, in Claim 1, delete “tube” and insert -- tubes --, therefor.

In column 4, line 66, in Claim 1, after “at” delete “the” and insert -- an --, therefor.

In column 5, line 10, in Claim 4, after “and” delete “the”.

In column 5, line 11, in Claim 4, after “towards” delete “the”.

Signed and Sealed this

Eighth Day of April, 2008

JON W. DUDAS
*Director of the United States Patent and Trademark Office*